United States Patent [19]

Giovagnoli

[11] Patent Number: 4,458,656

[45] Date of Patent: Jul. 10, 1984

[54] BALL PITCHING DEVICE WITH ARM BRAKE ASSEMBLY

[75] Inventor: Paul S. Giovagnoli, Kansas City, Mo.

[73] Assignee: Master Pitching Machine, Inc., Kansas City, Mo.

[21] Appl. No.: 439,924

[22] Filed: Nov. 8, 1982

[51] Int. Cl.[3] ..... F41B 3/04

[52] U.S. Cl. ..... 124/7; 188/84

[58] Field of Search ..... 124/7, 36, 6, 41 R; 273/26 D; 188/84; 3/27

[56] References Cited

U.S. PATENT DOCUMENTS

| | | | |
|---|---|---|---|
| D. 189,358 | 11/1960 | Giovagnoli . | |
| 2,679,650 | 6/1954 | Kleinekathöfer | 3/27 |
| 2,806,461 | 9/1957 | Giovagnoli . | |
| 2,877,757 | 3/1959 | Giovagnoli | 124/7 |
| 3,136,308 | 6/1964 | Giovagnoli . | |
| 3,207,147 | 9/1965 | Giovagnoli . | |
| 3,252,453 | 5/1966 | Giovagnoli . | |
| 3,640,262 | 2/1972 | Hunsicker | 124/7 |
| 4,175,535 | 11/1979 | Diem | 124/7 |

*Primary Examiner*—Richard J. Apley
*Assistant Examiner*—William R. Browne
*Attorney, Agent, or Firm*—Schmidt, Johnson, Hovey & Williams

[57] ABSTRACT

A ball pitching device having an arm brake assembly for a ball pitching machine is provided that rapidly decelerates the throwing arm of the machine once a ball has been released from the arm, thereby reducing unwanted oscillations of the throwing arm and prolonging the useful life of the pitching machine. The brake assembly includes a brake pad fixedly mounted to the throwing arm, and a generally arcuate brake shoe rotatable from a position wherein the throwing arm brake pad is frictionally engaged by the shoe once a ball has been released from the throwing arm, to a position spaced apart from the brake pad when the throwing arm is rotated for pitching of a ball.

2 Claims, 4 Drawing Figures

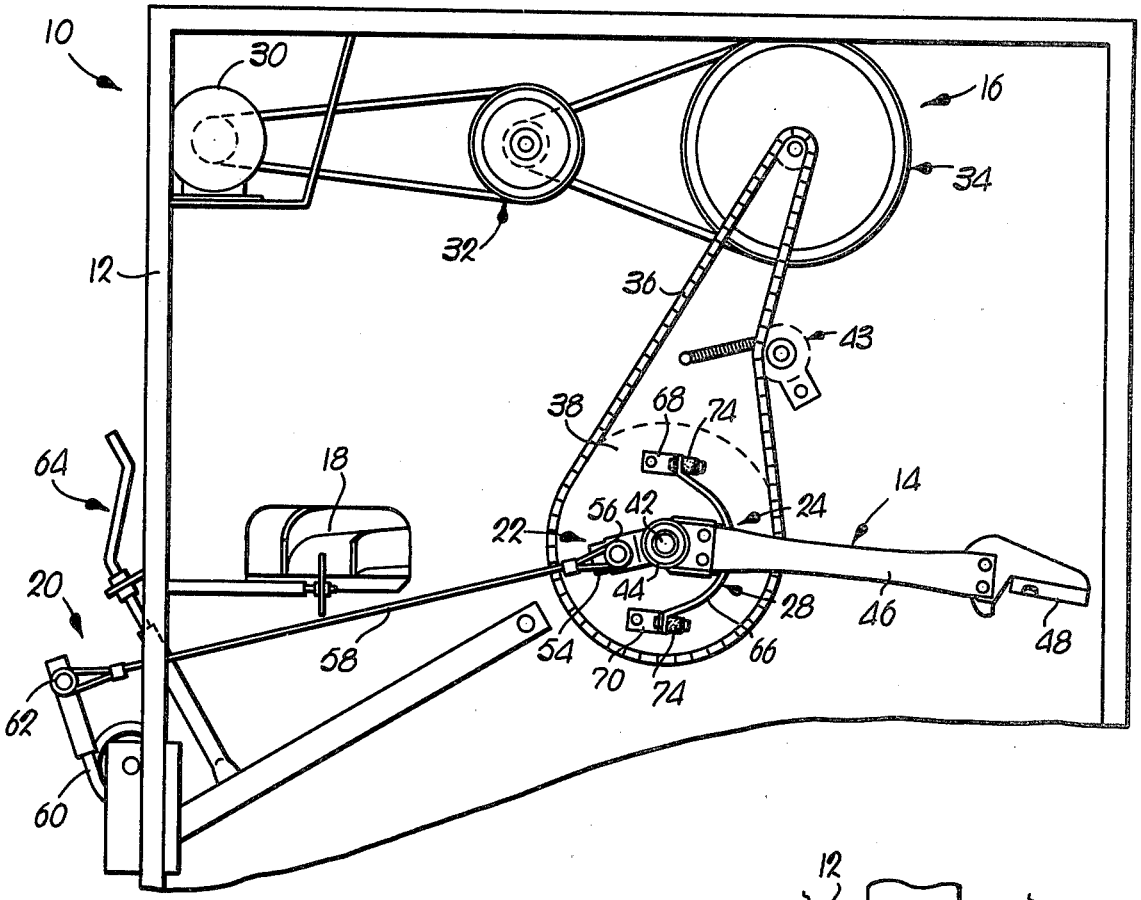
Fig. 1.
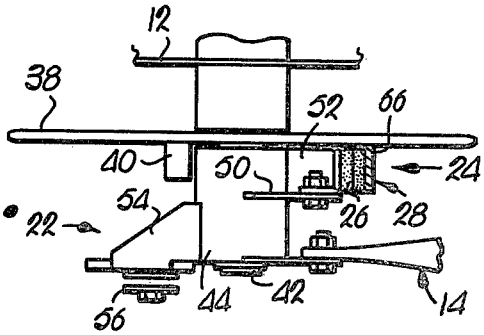
Fig. 4.
Fig. 2.
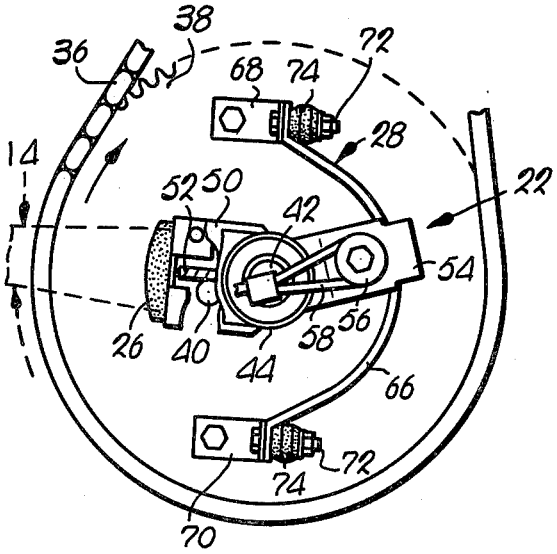
Fig. 3.
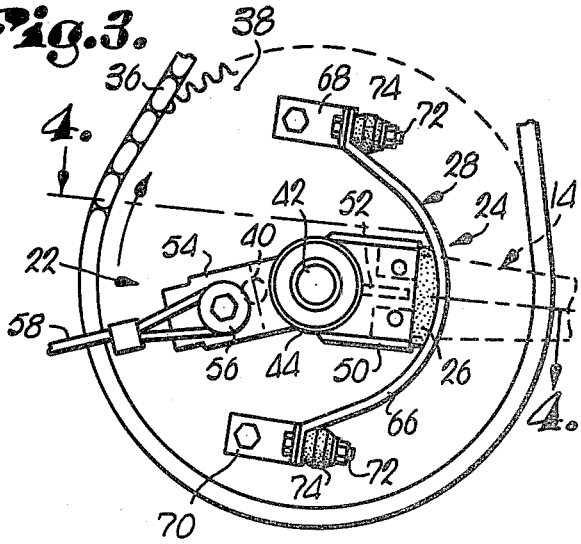

BALL PITCHING DEVICE WITH ARM BRAKE ASSEMBLY

BACKGROUND OF THE INVENTION

1. Field of the Invention

This invention relates to the field of automatic baseball pitching machines. In particular, it relates to a brake assembly for the throwing arm of an automatic ball pitching machine.

2. Description of the Prior Art

Machines for automatically throwing baseballs along successive, substantially uniform paths of travel are well-known. Such machines typically employ an elongated throwing arm and means for rotating the arm along a generally circular path of travel about a substantially horizontal axis. Kinetic energy imparted to the arm as it travels along a portion of its circular path of travel is stored by a spring or like mechanical device. The energy stored in the spring is instantaneously released at a particular point in the throwing arm's path of travel for rapidly accelerating a baseball supported at one end of the throwing arm.

The driving means for rotating the throwing arm of a pitching machine typically includes a rotatable gear having a projection thereon to engage one side of the throwing arm. The throwing arm is rotated along its circular path of travel when the projection is in engagement with the arm, and energy imparted to the throwing arm by the driving means is stored in the spring. The arm must be able to rapidly rotate along its path of travel independently of the driving means, however, once the energy stored within the spring is released and imparted to the arm. The arm's motion is therefore essentially uncontrolled until the projection of the driving means once again engages the throwing arm for controlled rotation of the throwing arm along its circular path of travel. The uncontrolled motion of the throwing arm has in previous pitching machines been manifested by a back and forth oscillation of the throwing arm as the energy imparted to the throwing arm by the spring is dissipated. The back and forth oscillation of the throwing arm has lead to metal fatigue and overall degradation of the pitching machine.

A ball pitching machine that included apparatus for controlling the motion of the throwing arm after the throwing arm has been rapidly accelerated for the pitching of a ball from the throwing arm would prolong the useful life of an individual pitching machine and would therefore be a decided advantage.

SUMMARY OF THE INVENTION

The problem outlined above is in large measure solved by the arm brake assembly for ball pitching machines in accordance with the present invention. That is to say, the arm brake assembly hereof provides a means for controlling the motion of a pitching machine throwing arm once the throwing arm has been rapidly accelerated for the pitching of a baseball. In particular, the arm brake assembly hereof includes a brake pad fixedly connected to the throwing arm, and a brake shoe engageable with the brake pad. The brake shoe is fixedly mounted to the gear that drives the throwing arm, and is rotatable to a position wherein the shoe engages the throwing arm brake pad once the throwing arm has released a baseball, to a position spaced apart from the throwing arm brake pad when the throwing arm is rotated for pick-up and subsequent throwing of a baseball.

BRIEF DESCRIPTION OF THE DRAWING

FIG. 1 is a fragmentary view of a pitching machine including an arm brake assembly in accordance with the present invention;

FIG. 2 is an enlarged, fragmentary view of the arm brake assembly in accordance with the present invention;

FIG. 3 is similar to FIG. 2, but depicts the brake pad in frictional engagement with the brake shoe of the arm brake assembly; and FIG. 4 is a sectional view taken along the line 4—4 of FIG. 3.

DETAILED DESCRIPTION OF THE DRAWING

Referring to the drawing, a pitching machine 10 broadly includes support frame 12, throwing arm 14, throwing arm drive means 16, ball chute 18, spring assembly 20, and spring tensioning and release mechanism 22. The arm brake assembly 24 broadly includes brake pad 26, and brake shoe 28.

Drive means 16 includes an electric motor 30, belt and pulley assemblies 32, 34, chain 36, and sprocketed drive gear 38. Arm engaging projection 40 is fixedly attached to one face of gear 38. Gear 38 is rotatably mounted on horizontally oriented shaft 42 Chain 36 is maintained in tension by tensioning device 43.

Arm 14 includes sleeve 44 rotatably mounted on shaft 42, elongated extension 46, and ball supporting receptacle 48. Brake pad 26 is fixedly mounted to bracket 50 extending from sleeve 44. Drive gear projection engaging element 52 extends outwardly from sleeve 44 in the vicinity of bracket 50 and brake pad 26.

Spring tensioning and release means 22 includes member 54 fixedly attached to, and extending outwardly from sleeve 44. Cable attachment point 56 comprises a collar rotatably mounted on member 54, spaced apart from sleeve 44. Cable 58 stretches between the attachment point 56 and spring assembly 20.

Spring assembly 20 includes spring 60, an attachment point 62 comprising a collar rotatably mounted on spring 60, and adjustment mechanism 64.

Brake shoe 28 includes a preferably metallic, arcuate friction member 66 fixedly attached to gear 38 by brackets 68, 70. Friction member 66 is attached to bracket 68 by identical bolt assemblies 72 that include cushions 74.

In operation, drive gear 38 is rotated in a clockwise direction, from the perspective of the figures. Gear projection 40 will engage element 52, thereby rotating throwing arm 14 through the first portion of a generally circular path of travel. The kinetic energy imparted to arm 14 by drive means 16 while the arm 14 traverses the first portion of its path of travel is transferred to spring 60 via cable 58, and stored therein for subsequent release.

Referring to FIG. 2, it will be understood that the arm 14 is rotated by driving means 16 until such time as cable connection point 56 is rotated over the center of shaft 42, in relation to cable connection point 62 of spring assembly 20. At that time, the kinetic energy stored within spring 60 is imparted to arm 14, and the arm 14 is rapidly accelerated along a second portion of its circular path of travel wherein the arm 14 is essentially out of engagement with driving means 16. It is to be understood that, as the arm 14 travels through the first portion of its path of travel, a ball is received within receptacle 48 from chute 18, and the ball supported within receptacle 48 is rapidly accelerated and released from receptacle 48 once the arm 14 is accelerated through the second portion of its path of travel.

The rapid acceleration of arm 14 will continue until such time as the brake pad 26 fixedly attached to arm 14 comes into engagement with friction member 66 of brake shoe 28. The frictional engagement of brake pad 26 and brake shoe 28 will cause arm 14 to rapidly decelerate along the third portion of its path of travel, thereby controlling the motion of arm 14 such that back and forth oscillations of the arm 14 are prevented.

As gear 38 continues its clockwise rotation, arm 14 will be retained in essentially one position due to the bias exerted on arm 14 through cable 58 by spring 60. Brake shoe 28 will therefore become disengaged from brake pad 26, since the shoe 28 is fixedly connected to, and rotates with, drive gear 38. Brake pad 26 will be totally disengaged from shoe 28 by the time projection 40 is rotated to a point to engage element 52. Drive gear 38 and arm 14 will continue through their generally circular paths of travel as described hereinabove, and arm 14 will be free to rapidly accelerate under the influence of spring 60, once connection point 56 is again rotated over center with respect to shaft 44 and connection point 62. Arm 14 will at that time be rapidly accelerated to pitch a second baseball, and will again be decelerated by the brake assembly 24 once the second ball is released.

What is claimed is:

1. An apparatus for throwing a ball including:

a throwing arm mounted for rotation through a circular path of travel constituting a complete circle;

means operably coupled to said arm for moving said arm through a first portion of said path of travel and thereby imparting kinetic energy to said arm;

means operably coupled to said arm for storing said kinetic energy while said arm is moved along said first portion of said path of travel;

means operably coupled to said storing means for rapidly releasing said stored kinetic energy and imparting said released energy to said arm for rapid acceleration of said arm along a second portion of said path of travel; and means operably associated with said arm for rapidly decelerating said arm along a third portion of said path of travel to damp out unwanted arm oscillations, said arm oscillation damping means including a pad and brake shoe coupled to the arm and said arm moving means respectively, said pad and brake shoe being located in relative dispositions such that the pad is brought into frictional engagement with the brake shoe only after the arm has been acceleratedly driven through the second portion of said circular path of travel and such frictional interengagement of the brake shoe and pad is terminated prior to coupling of the arm to said arm moving means to move the arm through said first portion of the path of travel of said arm.

2. An apparatus for throwing a ball including:

a throwing arm mounted for rotation through a circular path of travel constituting a complete circle;

means operably coupled to said arm for moving said arm through a first portion of said path of travel and thereby imparting kinetic energy to said arm;

means operably coupled to said arm for storing said kinetic energy while said arm is moved along said first portion of said path of travel;

means operably coupled to said storing means for rapidly releasing said stored kinetic energy and imparting said released energy to said arm for rapid acceleration of said arm along a second portion of said path of travel, means operably associated with said arm for rapidly decelerating said arm along a third portion of said path of travel to damp out unwanted arm oscillations, said decelerating means including a brake pad operably coupled to said arm, and a brake shoe engageable with said pad, said moving means including a gear engageable with said arm, said brake shoe being operably coupled to said gear for movement therewith, said shoe being positioned for engagement with said pad when said arm is along said third portion of said path of travel, and said shoe being positioned in spaced apart relationship from said pad when said arm is along portion of said path of travel other than said third portion.

* * * * *